United States Patent [19]

Kiraly et al.

[11] Patent Number: 4,546,544

[45] Date of Patent: Oct. 15, 1985

[54] ONE-PIECE DISPOSABLE RAZOR WITH BLADE PROTECTOR LATCHED RELEASABLY TO RAZOR

[75] Inventors: Ernest F. Kiraly, Fairfield; Frank A. Ferraro, Trumbull, both of Conn.

[73] Assignee: Warner-Lambert Company, Morris Plains, N.J.

[21] Appl. No.: 625,434

[22] Filed: Jun. 28, 1984

[51] Int. Cl.[4] ..... B26B 21/40

[52] U.S. Cl. ..... 30/90; 30/47; 30/77

[58] Field of Search ..... 30/47, 77, 84, 90

[56] References Cited

U.S. PATENT DOCUMENTS 3,492,722 2/1970 Sieve ..... 30/47

4,446,619 5/1984 Jacobson ..... 30/47

FOREIGN PATENT DOCUMENTS 4483 4/1980 Japan .

*Primary Examiner*—Douglas D. Watts

*Attorney, Agent, or Firm*—R. S. Strickler

[57] ABSTRACT

A one-piece disposable razor having a blade edge protector molded integrally with the razor operable to latch releasably to the razor.

4 Claims, 5 Drawing Figures

ONE-PIECE DISPOSABLE RAZOR WITH BLADE PROTECTOR LATCHED RELEASABLY TO RAZOR

BACKGROUND OF THE INVENTION

The present invention relates to disposable razors and relates in particular to one-piece ultra low cost disposable razors.

The disposable razor market is highly competitive, and it is vital that manufacturing costs, particularly material handling costs, be held to an absolute minimum.

In addition, a continuing effort must be made to seek out cost reduction methods and procedures.

Molding a razor of plastic in one piece is a prime necessity in reducing expense of handling piece-parts.

The language "one piece" in this application is intended to refer to the initial molding of all elements of a razor as a single piece-part save the blade package.

"Blade package" is intended to denote a single or twin blade (with blade spacer if twin), all blades having a single cutting edge.

Razors of one-piece construction embracing inventions distinct from the present invention are disclosed and described in copending applications U.S. Ser. No. 615,604 filed May 31, 1984, U.S. Ser. No. 615,603 filed May 31, 1984, and U.S. Ser. No. 607,041 filed May 4, 1984.

SUMMARY OF THE INVENTION

In the above background it is a principal feature of the present invention to provide a one-piece molded plastic razor which includes a blade edge protector connected to the main body of the razor by breakaway links where the protector is operable at the time of manufacture to be latched releasably to the razor body immediately following its being broken away from the one-piece molding.

A further feature of the invention is to provide a disposable razor with a blade edge protector which need not be molded in and transported from a molding machine or a separate molding die.

A disposable razor initially defining a one-piece molded plastic piece-part may comprise a head having a blade support for receiving a blade package and a face-engaging surface, a guard bar, a handle, and a blade edge protector operable to engage the head releasably.

BRIEF DESCRIPTION OF THE DRAWINGS

Other features and advantages of the present invention will become more apparent from an examination of the succeeding specification when read in conjunction with the appended drawings, in which.

DESCRIPTION OF PREFERRED EMBODIMENT

Figure 1:
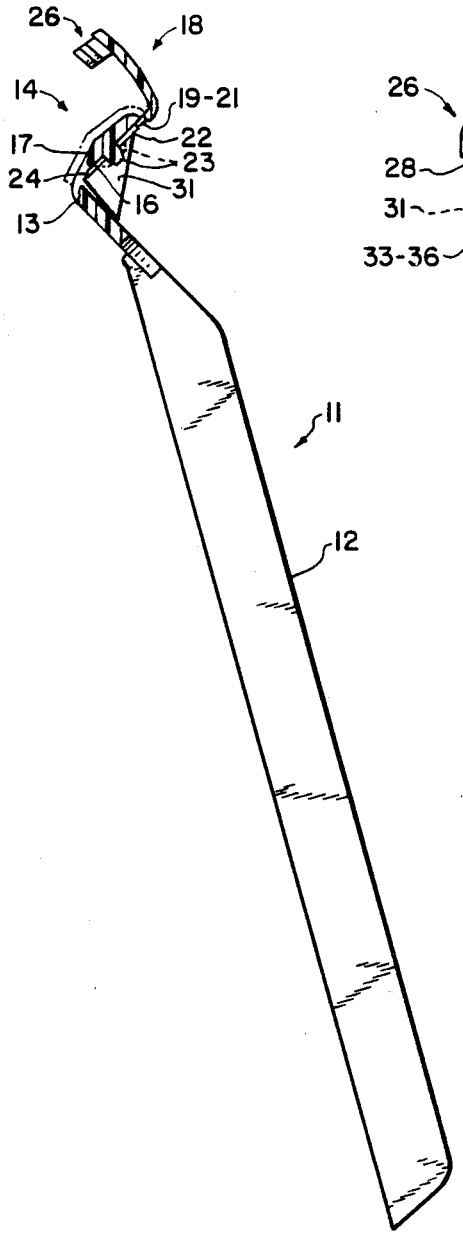
FIG. 1 is a vertical section of a one-piece molding as it is ejected from the mold.
Figure 2:
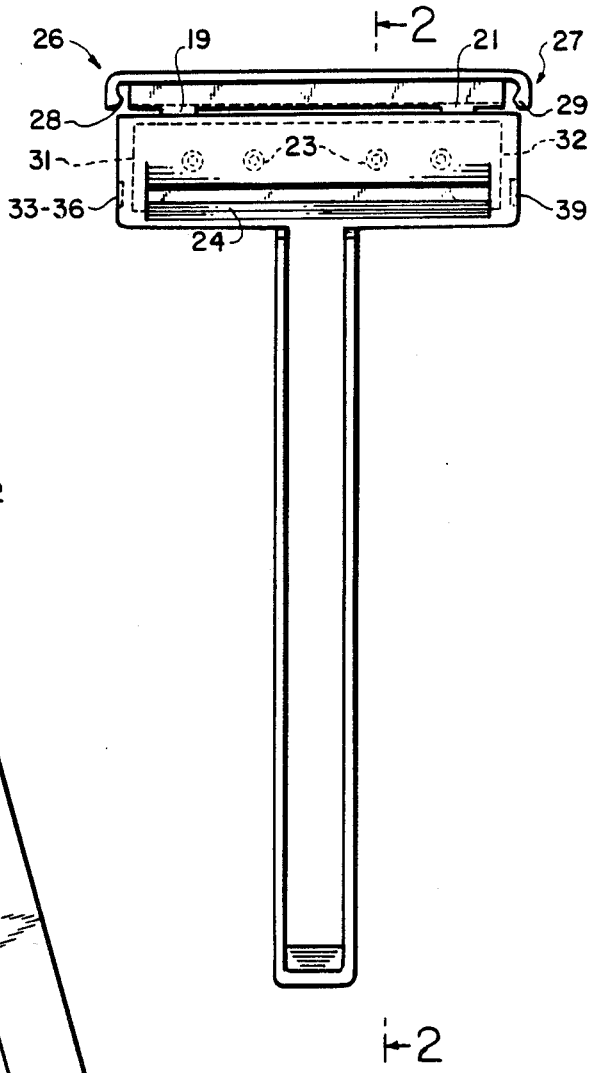
FIG. 2 is a top plan view of the razor of FIG. 1.
Figure 3:
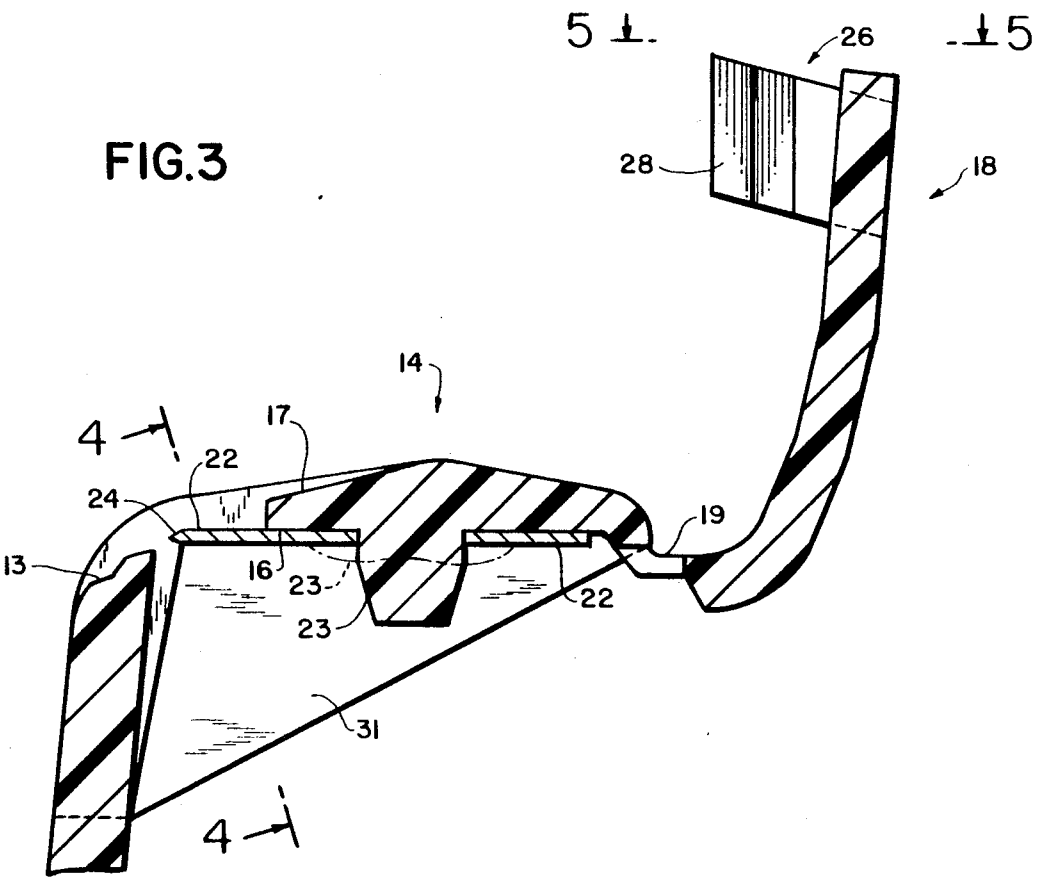
FIG. 3 is an enlarged view of a portion of FIG. 1.
Figure 4:
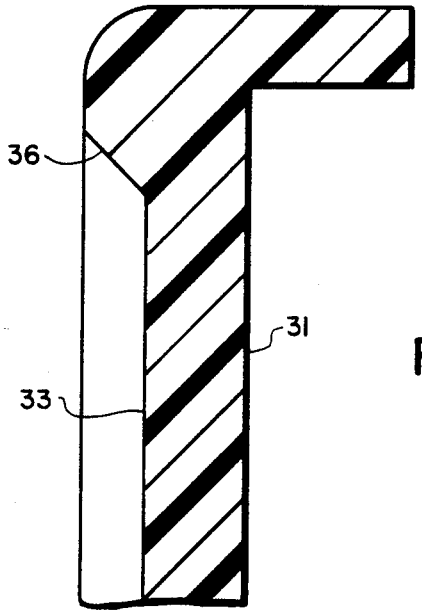
FIG. 4 is a sectional view of FIG. 3 in the plane of line 4—4.
Figure 5:
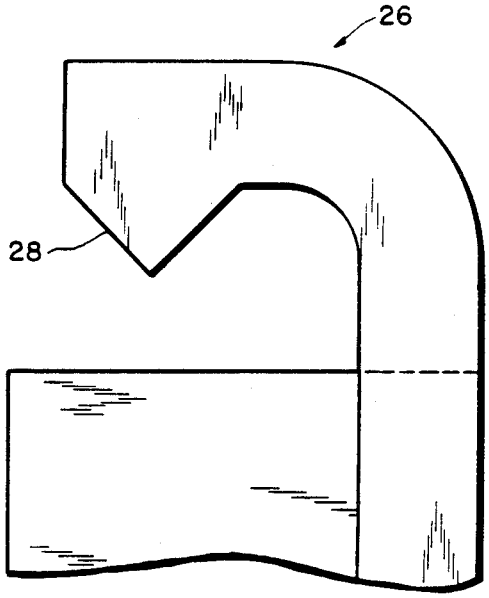
FIG. 5 is a detail of the latching claw.

Referring now to the drawings, the reference numeral 11 indicates a one-piece molded plastic razor as it appears immediately after ejection from a mold comprising a handle 12, a guard bar 13, a head 14 having a blade package support surface 16, a face-engaging surface 17, and a blade edge protector 18 connected to the head 14 by breakaway links 19 and 21.

After securing a blade package 22 upon blade support surface 16, integral rivet or rivets 23 are upset to the dotted line configuration of FIG. 1.

The cutting edge 24 of the blade package is positioned between the guard bar 13 and the face-engaging surface 17 in accord with well-known principles of blade geometry.

Incidentally, the means of securing the blade package is not critical to the present invention and may take form and structure which security of blade package and assembly machine design configurations dictate.

The blade edge protector 18 is formed with a pair of latching means including claws 26 and 27 and cam followers 28 and 29 and the claws are free to flex outwardly and snap inwardly as the cam followers traverse mating cams, as will be apparent immediately.

Brackets 31 and 32 connecting the head 14 and the handle 12 and supporting the head are formed with indentations 33 and 34 having cam surfaces 36 and 37 which lead into said indentations.

As an assembly step in the course of manufacture of the razor, the blade edge protector is manipulated automatically to (1) break the links 19 and 21 and (2) snap the protector 18 releasably into latching engagement with the head as shown in dotted lines in FIG. 1.

During this occurrence, the followers 28 and 29 traverse their respective cams 36 and 37 and thereafter the claws 26 and 27 latch releasably with the mating indentations 33 and 34.

It is anticipated that a wide variety of modifications may be devised in this invention without departing from the spirit and scope thereof.

For example, the cam - cam follower arrangement can be reversed and the blade package may be attached frictionally with blade barbs engaging blade slots in the head 14.

What is claimed is:

1. A one-piece low cost disposable razor comprising a head having a support surface for receiving at least one single cutting edge blade and having a face-engaging surface opposite said support surface, said face-engaging surface having a forward margin adjacent a blade cutting edge and an opposite rear margin adjacent a rear edge of a blade, a guard bar, a handle and a temporary blade edge protector all molded as a single piece-part, said protector being joined to said head by means of breakaway links located at said rear margin of said face-engaging surface, and protector being operable to overlay the face-engaging surface and to engage the head releasably when said links are broken, one of said head and said protector being formed with a pair of latching elements for engaging mating indentations on the other of said head and said protector.

2. The razor of claim 1 in which the latching elements define claws formed integrally with the protector and operate to latch releasably with mating indentations in the head.

3. The razor of claim 2 in which the head is formed with cam surfaces leading to mating indentations and each claw includes a cam follower whereby the claws make a snap-fit with said indentations after cam action.

4. The razor of claim 1 in which the breakaway links define a spaced pair of links.

* * * * *